US011833823B2

(12) United States Patent
Hirano et al.

(10) Patent No.: US 11,833,823 B2
(45) Date of Patent: Dec. 5, 2023

(54) LIQUID EJECTING DEVICE SETTING NON-EJECTION DRIVE TIME BASED ON UNCAPPED TIME, TEMPERATURE AND HUMIDITY

(71) Applicant: Brother Kogyo Kabushiki Kaisha, Nagoya (JP)

(72) Inventors: Mikio Hirano, Okazaki (JP); Masaki Mori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/583,808

(22) Filed: Jan. 25, 2022

(65) Prior Publication Data

US 2022/0242125 A1 Aug. 4, 2022

(30) Foreign Application Priority Data

Jan. 29, 2021 (JP) ..... 2021-013163

(51) Int. Cl.
*B41J 2/165* (2006.01)

(52) U.S. Cl.
CPC ..... *B41J 2/165* (2013.01); *B41J 2/16505* (2013.01); *B41J 2002/16567* (2013.01); *B41J 2002/16573* (2013.01)

(58) Field of Classification Search
CPC ..... B41J 2/165; B41J 2/16505; B41J 2002/16567; B41J 2002/16573
See application file for complete search history.

(56) References Cited

U.S. PATENT DOCUMENTS

| | | | | |
|---|---|---|---|---|
| 11,584,124 | B2 * | 2/2023 | Yamaguchi | D06B 11/0023 |
| 2010/0302308 | A1 | 12/2010 | Matsuura et al. | |
| 2019/0016122 | A1 | 1/2019 | Shinbara et al. | |

FOREIGN PATENT DOCUMENTS

| | | | |
|---|---|---|---|
| JP | 2010-274421 | A | 12/2010 |
| JP | 2019-014158 | A | 1/2019 |
| JP | 2020-114628 | A | 7/2020 |

* cited by examiner

*Primary Examiner* — Geoffrey S Mruk
(74) *Attorney, Agent, or Firm* — BURR PATENT LAW, PLLC

(57) ABSTRACT

A liquid ejecting device includes a head, a cap, a moving mechanism and a controller. The moving mechanism is configured to move the head and the cap relative to each other to switch the cap between a capping state in which the cap is in contact with the head and covers the plurality of nozzles and a non-capping state in which the cap is separated from the head and uncovers the same. The controller is configured to perform setting a non-ejection drive time based on an uncapped time duration which is a length of time from a timing at which the cap is switched to the non-capping state until a timing at which the cap is switched back to the capping state. The controller is configured to perform vibrating meniscus of liquid in the plurality of nozzles during the non-ejection drive time.

18 Claims, 8 Drawing Sheets

LIQUID EJECTING DEVICE SETTING NON-EJECTION DRIVE TIME BASED ON UNCAPPED TIME, TEMPERATURE AND HUMIDITY

CROSS REFERENCE TO RELATED APPLICATIONS

This application claims priority from Japanese Patent Application No. 2021-013163 filed Jan. 29, 2021. The entire content of the priority application is incorporated herein by reference.

BACKGROUND

Prior art describes a method of performing maintenance on a liquid droplet ejecting head. While a cap is in a capping state on the head, an actuator is driven to generate micro-vibrations that vibrate pressure chambers to a degree that does not eject liquid from the nozzles. The application of these micro-vibrations can suppress the thickening of liquid in the nozzles.

SUMMARY

However, the prior art does not specify any length of time (non-ejection drive time) for generating these micro-vibrations (non-ejection driving process). This creates a problem in implementing high-speed recording since a non-ejection drive time that is longer than necessary would delay the start of the next recording process.

In view of the foregoing, it is an object of the present disclosure to provide a liquid-ejecting device capable of implementing high-speed recording in a configuration that executes a non-ejection driving process while the recording head is capped, and a method and program for controlling the liquid-ejecting device.

In order to attain the above and other object, according to one aspect, the present disclosure provides a liquid ejecting device including a head, a cap, a moving mechanism and a controller. The head includes a plurality of nozzles. The moving mechanism is configured to move the head and the cap relative to each other to switch the cap between a capping state in which the cap is in contact with the head and covers the plurality of nozzles and a non-capping state in which the cap is separated from the head and uncovers the plurality of nozzles. The controller is configured to perform: first switching the cap from the capping state to the non-capping state by driving the moving mechanism; after completing the first switching, second switching the cap from the non-capping state to the capping state by driving the moving mechanism; setting a non-ejection drive time based on an uncapped time duration which is a length of time from a timing at which the cap is switched to the non-capping state in the first switching until a timing at which the cap is switched back to the capping state in the second switching; after completing the second switching, vibrating meniscus of liquid in the plurality of nozzles without ejecting the liquid from the plurality of nozzles for the non-ejection drive time set in the setting while maintaining the cap in the capping state; and after completing the vibrating meniscus of the liquid in the plurality of nozzles, maintaining the cap in the capping state without vibrating the meniscus until receiving a recording command.

With this configuration, the controller sets the non-ejection drive time based on the uncapped time. As a result, the controller can avoid executing the vibrating meniscus of the liquid in the plurality of nozzles longer than necessary and, hence, can avoid delaying the start of the next recording process. Therefore, the liquid ejecting device can implement high-speed recording with a configuration for executing the vibrating meniscus of the liquid in the plurality of nozzles while the cap is in the capping state.

According to another aspect, the present disclosure provides a method for controlling a liquid ejecting device. The liquid ejecting device includes a head, a cap and a moving mechanism. The head includes a plurality of nozzles. The moving mechanism is configured to move the head and cap relative to each other to switch the cap between a capping state in which the cap is in contact with the head and covers the plurality of nozzles and a non-capping state in which the cap is separated from the head and uncovers the plurality of nozzles. The method includes: firstly switching the cap from the capping state to the non-capping state by driving the moving mechanism; after completing the firstly switching, secondly switching the cap from the non-capping state to the capping state by driving the moving mechanism; setting a non-ejection drive time based on an uncapped time duration which is a length of time from a timing at which the cap is switched to the non-capping state in the firstly switching until a timing at which the cap is switched back to the capping state in the secondly switching; after completing the secondly switching, vibrating meniscus of liquid in the plurality of nozzles without ejecting the liquid from the plurality of nozzles for the non-ejection drive time set in the setting while maintaining the cap in the capping state; and after completing the vibrating meniscus of the liquid in the plurality of nozzles, maintaining the cap in the capping state without vibrating the meniscus until receiving a recording command.

With this configuration, the controller sets the non-ejection drive time based on the uncapped time. As a result, the controller can avoid executing the vibrating meniscus of the liquid in the plurality of nozzles longer than necessary and, hence, can avoid delaying the start of the next recording process. Therefore, the liquid ejecting device can implement high-speed recording with a configuration for executing the vibrating meniscus of the liquid in the plurality of nozzles while the cap is in the capping state.

According to still another aspect, the present disclosure provides a non-transitory computer-readable storage medium storing a set of program instructions for controlling a liquid ejecting device. The liquid ejecting device includes a controller, a head, a cap and a moving mechanism. The head includes a plurality of nozzles. The moving mechanism is configured to move the head and cap relative to each other to switch the cap between a capping state in which the cap is in contact with the head and covers the plurality of nozzles and a non-capping state in which the cap is separated from the head and uncovers the plurality of nozzles. The set of program instructions, when executed by the controller, causes the controller to perform: first switching the cap from the capping state to the non-capping state by driving the moving mechanism; after completing the first switching, second switching the cap from the non-capping state to the capping state by driving the moving mechanism; setting a non-ejection drive time based on an uncapped time duration which is a length of time from a timing at which the cap is switched to the non-capping state in the first switching until a timing at which the cap is switched back to the capping state in the second switching; after completing the second switching, vibrating meniscus of liquid in the plurality of nozzles without ejecting the liquid from the plurality of nozzles for the non-ejection drive time set in the setting while maintaining the cap in the capping state; and after completing the vibrating meniscus of the liquid in the plurality of nozzles, maintaining the cap in the capping state without vibrating the meniscus until receiving a recording command.

With this configuration, the controller sets the non-ejection drive time based on the uncapped time. As a result, the controller can avoid executing the vibrating meniscus of the liquid in the plurality of nozzles longer than necessary and, hence, can avoid delaying the start of the next recording process. Therefore, the liquid ejecting device can implement high-speed recording with a configuration for executing the vibrating meniscus of the liquid in the plurality of nozzles while the cap is in the capping state.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

First Embodiment

First, the overall structure of a printer 100 according to a first embodiment of the present disclosure and the structures of individual components in the printer 100 will be described with reference to FIGS. 1 through 3.

Figure 1:
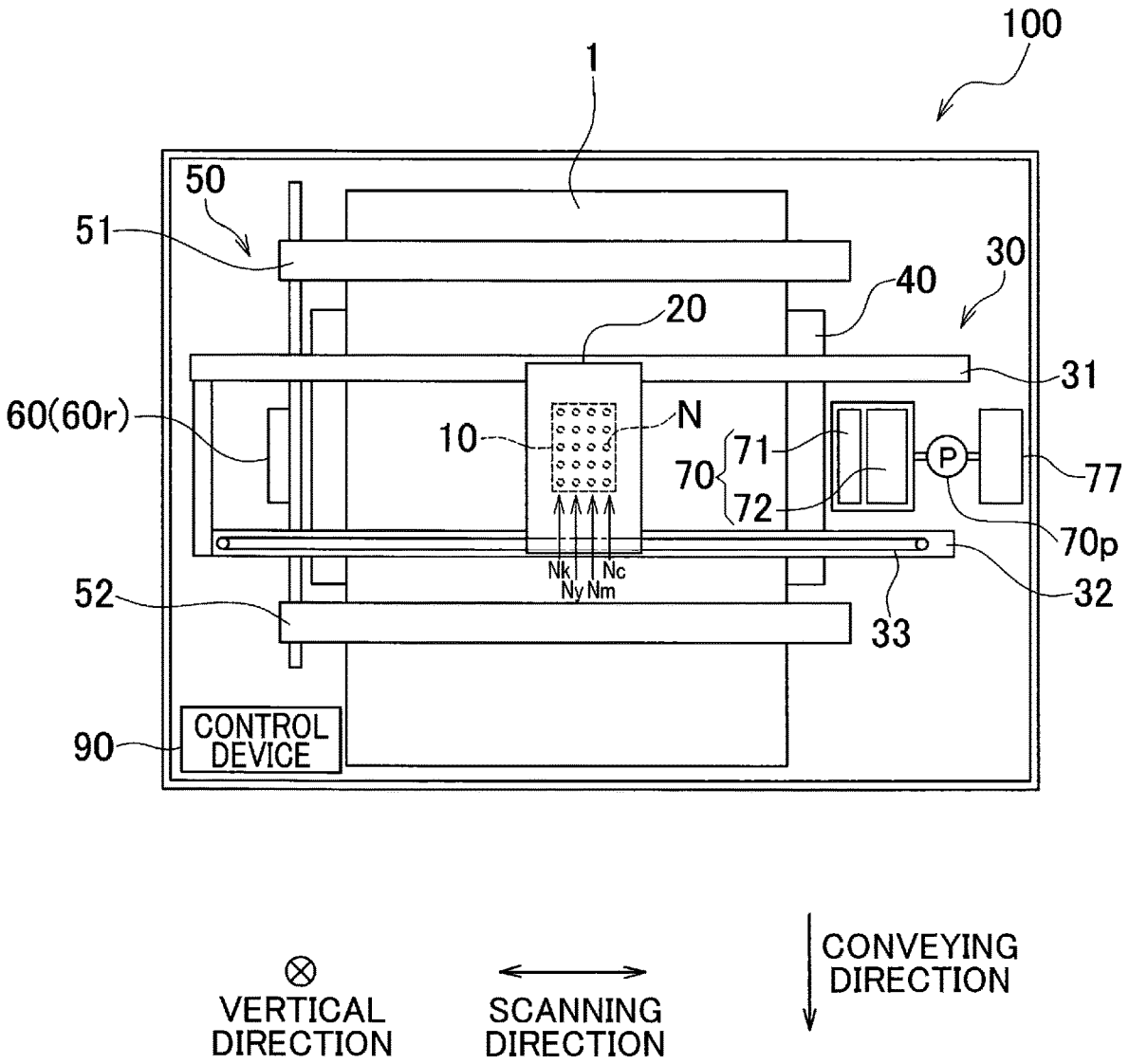
FIG. 1 is a plan view illustrating an overall structure of a printer.

As shown in FIG. 1, the printer 100 is provided with an inkjet head 10 having a plurality of nozzles N formed in the bottom surface thereof, a carriage 20 that holds the inkjet head 10, a scanning mechanism 30 that moves the carriage 20 in scanning directions (directions orthogonal to the vertical), a platen 40 for supporting a sheet 1 (the recording medium) from below, a conveying mechanism 50 that conveys the sheet 1 in a conveying direction (a direction orthogonal to the scanning direction and the vertical), an ink receiving member 60 disposed on one side of the platen 40 in the scanning direction, a cap 70 disposed on the other side of the platen 40 in the scanning direction, and a control device 90.

The nozzles N are arranged in four nozzle rows Nc, Nm, Ny, and Nk juxtaposed in the scanning direction. Each of the nozzle rows Nc, Nm, Ny, and Nk is configured of a plurality of nozzles N aligned in the conveying direction. Nozzles N configuring the nozzle row Nc eject cyan ink; nozzles N configuring the nozzle row Nm eject magenta ink; nozzles N configuring the nozzle row Ny eject yellow ink; and nozzles N configuring the nozzle row Nk eject black ink.

The black ink is a pigment ink that contains a water-absorbing polymer (water absorbent material). However, the color inks (cyan, magenta, and yellow) are dye inks that do not contain any water-absorbing polymers. The black ink is an example of a first liquid. The nozzle row Nk is an example of a first nozzle group. Each of the color inks is an example of second liquid. A set of nozzle rows Nc, Nm, and Ny is an example of second nozzle group.

The scanning mechanism 30 includes a pair of guides 31 and 32, and a belt 33 coupled to the carriage 20. Each of the guides 31 and 32 and the belt 33 extends in the scanning directions. A carriage motor 30*m* (see FIG. 3) is driven under control of the control device 90. When the carriage motor 30*m* is driven, the belt 33 circulates, and the carriage 20 coupled to the belt 33 moves in the scanning directions along the guides 31 and 32.

The platen 40 is disposed beneath the inkjet head 10. The top surface of the platen 40 supports sheets 1.

The conveying mechanism 50 has two roller pairs 51 and 52. The inkjet head 10 and platen 40 are arranged between the roller pairs 51 and 52 in the conveying direction. A conveying motor 50*m* (see FIG. 3) is driven under control of the control device 90. When the conveying motor 50*m* is driven, the roller pairs 51 and 52 rotate while gripping the sheet 1 and convey the sheet 1 in the conveying direction. In this way, the conveying mechanism 50 conveys the sheet 1 relative to the inkjet head 10.

The ink receiving member 60 is arranged between the guides 31 and 32 in the conveying direction. The ink receiving member 60 has a flushing region 60*r* on the top surface thereof. The flushing region 60*r* is outside a conveying region through which the sheets 1 are conveyed by the conveying mechanism 50 and is positioned adjacent to the conveying region in the scanning direction. In a flushing process described later, ink is flushed toward the flushing region 60*r*.

The cap 70 is a box-like member with an opening in the top surface. A partitioning wall extending in the conveying direction partitions the interior space of the cap 70 into two spaces. One of the two spaces constitutes a first cap 71 for the nozzle row Nk, and the other constitutes a second cap 72 for the nozzle rows Nc, Nm, and Ny. The cap 70 can be moved vertically by driving a cap lifting/lowering motor 70*m* (see FIG. 3). When the inkjet head 10 is positioned above the cap 70, the cap lifting/lowering motor 70*m* is driven under control of the control device 90. When the cap lifting/lowering motor 70*m* is driven, the cap 70 moves upward and contacts the bottom surface of the inkjet head 10, forming hermetically enclosed spaces between the cap 70 and inkjet head 10. Specifically, the nozzles N constituting the nozzle row Nk are covered by the first cap 71, and the nozzles N constituting the nozzle rows Nc, Nm, and Ny are covered by the second cap 72 such that the hermetically enclosed spaces between the cap 70 and inkjet head 10 are formed. The state of the cap 70 at this time will be called a "capping state." Conversely, the state of the cap 70 when the cap 70 is separated from the inkjet head 10 and not covering the nozzles N (when hermetically enclosed spaces are not formed between the cap 70 and inkjet head 10) will be called a "non-capping state."

Here, the scanning mechanism 30 (see FIG. 1) and the cap lifting/lowering motor 70*m* (see FIG. 3) move the inkjet head 10 and cap 70 relative to each other in order to selectively place the cap 70 in the capping state and non-capping state. The scanning mechanism 30 and cap lifting/lowering motor 70*m* are examples of moving mechanism.

The cap 70 is in communication with a waste ink tank 77 via a tube and a suction pump 70*p*. The suction pump 70*p* is driven under control of the control device 90 when the cap 70 is in the capping state. The drive of the suction pump 70*p* depressurizes the enclosed spaces between the cap 70 and inkjet head 10, forcibly discharging ink from the nozzles N. The discharged ink collects in the cap 70 and flows into the waste ink tank 77.

Figure 2:
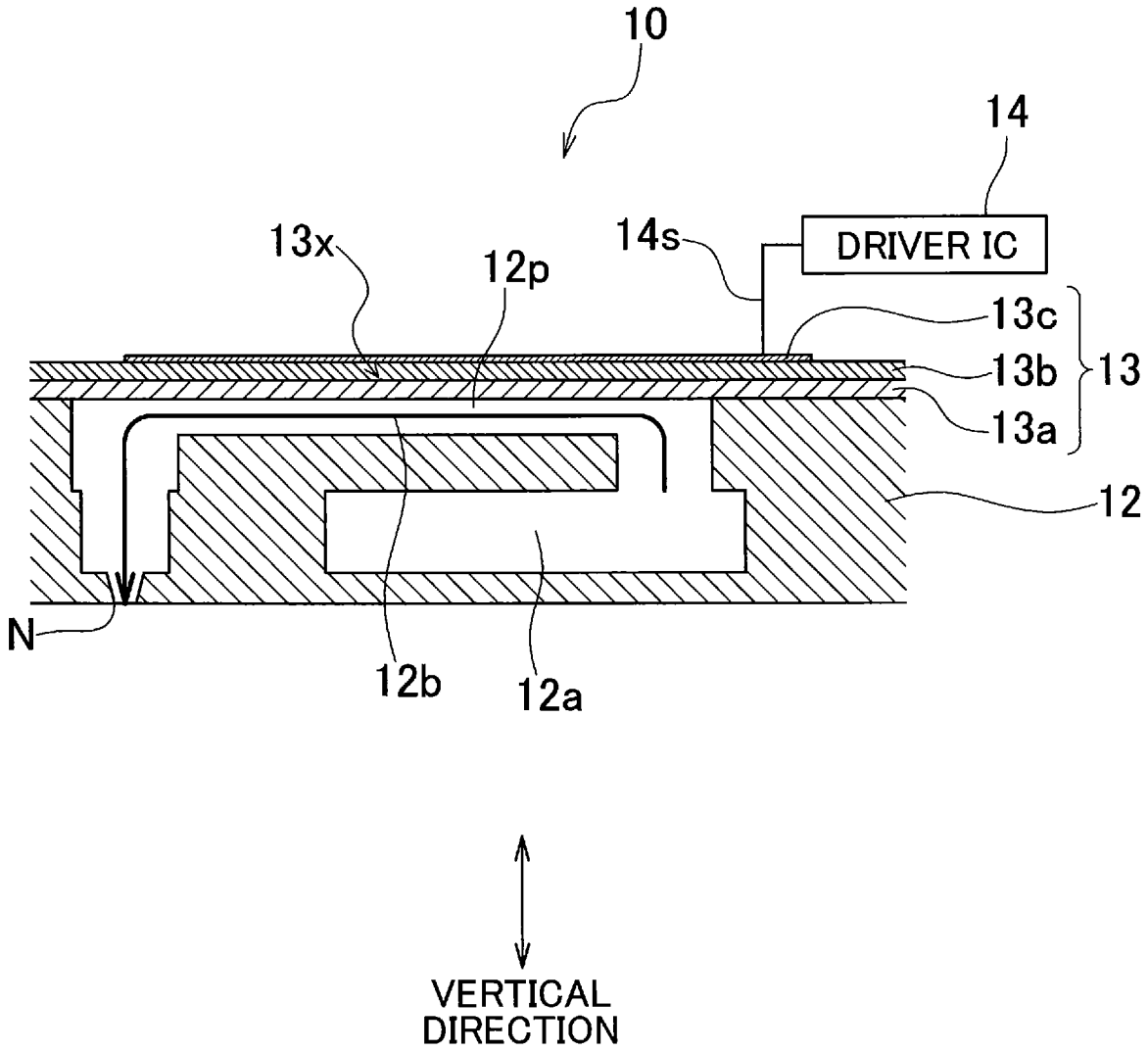
FIG. 2 is a cross-sectional view illustrating a head shown in FIG. 1.

As shown in FIG. 2, the inkjet head 10 includes a channel unit 12, and an actuator unit 13.

A plurality of nozzles N (see FIG. 1) is formed in the bottom surface of the channel unit 12. A common channel 12*a* and individual channels 12*b* are formed inside the channel unit 12. The common channel 12*a* communicates with an ink tank (not shown). The individual channels 12*b* are provided individually for each nozzle N. Each individual channel 12*b* leads from an outlet of the common channel 12*a* to the corresponding nozzle N via a pressure chamber 12*p*. Each of the plurality of pressure chambers 12*p* is open in the top surface of the channel unit 12.

The actuator unit 13 includes a metal vibration plate 13*a* arranged on the top surface of the channel unit 12 so as to cover the plurality of pressure chambers 12*p*, a piezoelectric layer 13*b* disposed on the top surface of the vibration plate 13*a*, and a plurality of individual electrodes 13*c* arranged on the top surface of the piezoelectric layer 13*b* at positions corresponding to the pressure chambers 12*p*.

The vibration plate 13*a* and each of the individual electrodes 13*c* are electrically connected to a driver IC 14. The driver IC 14 maintains the vibration plate 13*a* at ground potential while varying the potentials of the individual electrodes 13*c* between ground potential and drive potentials. Specifically, the driver IC 14 generates drive signals based on control signals received from the control device 90 (a waveform signal FIRE and a selection signal SIN) and supplies the drive signals to the individual electrodes 13*c* via signal lines 14*s*. Based on these signals, the potentials of the individual electrodes 13*c* are changed among the drive potentials and ground potential.

Figure 4:
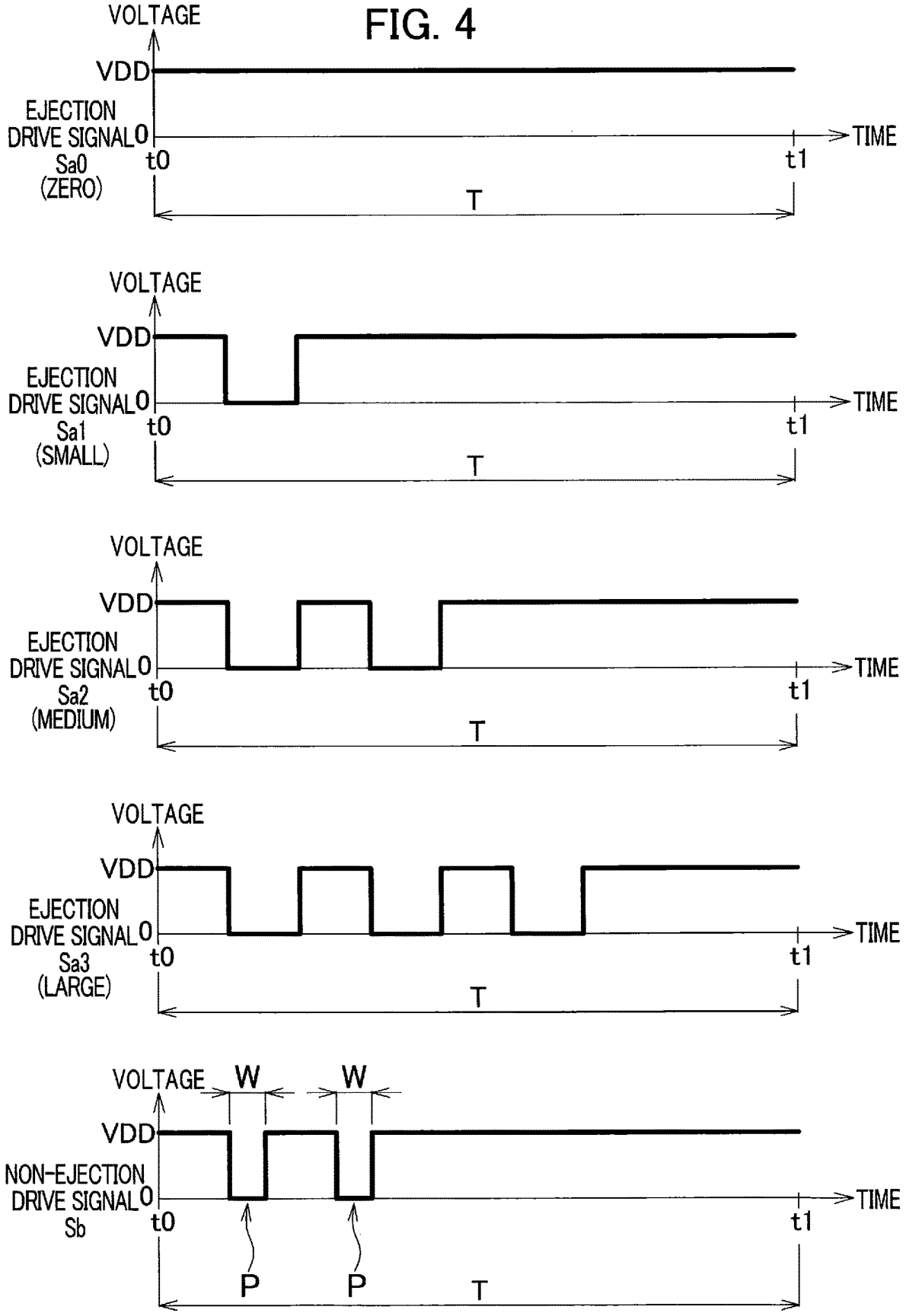
FIG. 4 is a graph illustrating ejection drive signals and a non-ejection drive signal both of which outputted by a driver IC of head.

As shown in FIG. 4, the drives signals include ejection drive signals Sa0-Sa3 and a non-ejection drive signal Sb.

Each of the ejection drive signals Sa0-Sa3 corresponds to a quantity of ink to be ejected from a nozzle N per unit time T (a recording cycle from a timing t0 to a timing t1). The unit time T is the length of time required to move the sheet 1 relative to the inkjet head 10 a unit distance corresponding to the resolution of the image being formed on the sheet 1. Hence, the unit time T corresponds to one pixel.

The ejection drive signal Sa0 for an ejection quantity "zero" includes no pulses per unit time T and, hence, does not eject ink from the nozzle N. The ejection drive signal Sa1 for an ejection quantity "small" includes one pulse per unit time T for ejecting a small droplet of ink from the nozzle N. The ejection drive signal Sa2 for an ejection quantity "medium" includes two pulses per unit time T for ejecting a medium droplet of ink from the nozzle N. The ejection drive signal Sa3 for an ejection quantity "large" includes three pulses per unit time T for ejecting a large droplet of ink from the nozzle N.

During an initial state in the embodiment, a drive potential VDD is applied to each individual electrode 13*c*. As a result, the portions of the vibration plate 13*a* and piezoelectric layer 13*b* interposed between each individual electrode 13*c* and corresponding pressure chamber 12*p* deform convexly toward the pressure chamber 12*p*. Hereinafter, these portions of the vibration plate 13*a* and piezoelectric layer 13*b* will be called actuators 13*x*.

The ejection drive signal Sa0 maintains the individual electrode 13*c* at the drive potential VDD, which maintains the corresponding actuator 13*x* in a state convexly deformed toward the pressure chamber 12*p*.

With each of the ejection drive signals Sa1-Sa3, the actuator 13*x* becomes flat when the corresponding individual electrode 13*c* is switched to ground potential, thereby increasing the volume of the corresponding pressure chamber 12*p* from its initial state. At this time, ink is drawn into the individual channel 12*b* from the common channel 12*a*. Subsequently, the drive potential VDD is once again applied to the individual electrode 13*c* at a prescribed timing, causing the actuator 13*x* to deform again convexly toward the pressure chamber 12*p*. The decreased volume of the pressure chamber 12*p* increases pressure in the ink, ejecting an ink droplet from the nozzle N.

An actuator 13*x* is provided for each of the individual electrodes 13*c* (i.e., each nozzle N). Each of the actuators 13*x* can be independently deformed according to the potential supplied to the corresponding individual electrode 13*c*.

The non-ejection drive signal Sb functions to vibrate the meniscus of ink inside the nozzle N without ejecting ink from the nozzle N. For example, the non-ejection drive signal Sb includes a plurality of pulses P having a smaller pulse width W than pulses included in the ejection drive signals Sa1-Sa3.

Figure 3:
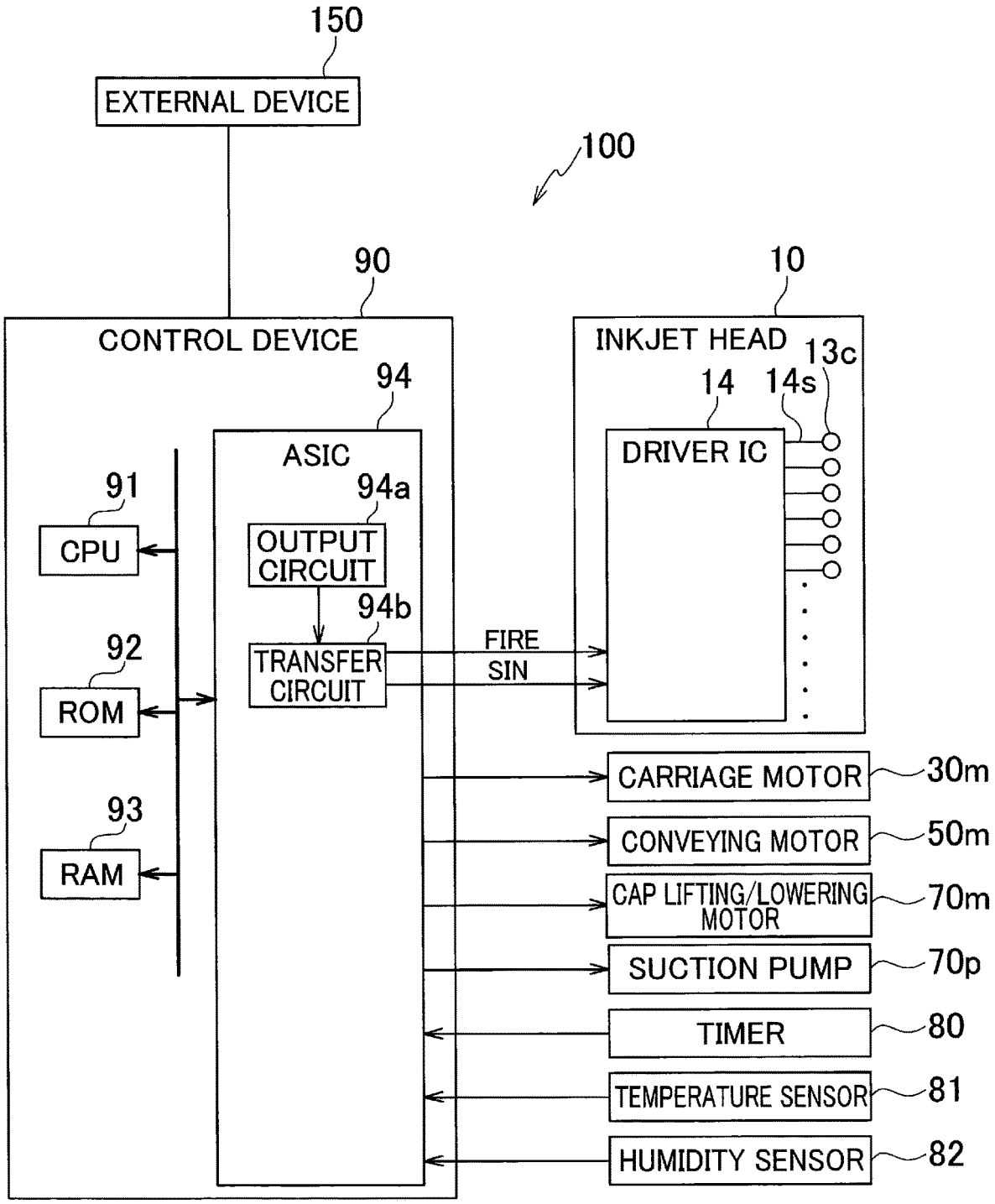
FIG. 3 is a block diagram illustrating an electric structure of the printer shown in FIG. 1.

As shown in FIG. 3, the control device 90 includes a central processing unit (CPU) 91, a read-only memory (ROM) 92, a random-access memory (RAM) 93, and an application-specific integrated circuit (ASIC) 94. The CPU 91 and ASIC 94 are examples of a controller.

The ROM 92 is a storage medium storing programs and data according to which the CPU 91 and ASIC 94 perform various control. The RAM 93 temporarily stores data (image data and the like) used when the CPU 91 and ASIC 94 execute programs. The control device 90 is connected to and capable of communicating with an external device 150, such as a personal computer. The CPU 91 and ASIC 94 execute a recording process and the like based on data inputted from the external device 150 or an input unit of the printer 100 (switches or buttons provided on the outer casing of the printer 100).

In the recording process, the ASIC 94 drives the driver IC 14, carriage motor 30*m*, and conveying motor 50*m* in conformance with commands from the CPU 91 and based on recording commands received from the external device 150 or the like in order to alternately perform a conveying operation and a scanning operation. In the conveying operation, the conveying mechanism 50 conveys the sheet 1 a prescribed amount in the conveying direction. In the scanning operation, the inkjet head 10 is moved in the scanning direction while being controlled to eject ink from the nozzles N. By alternately performing these operations, the ASIC 94 forms ink dots on the sheet 1 in order to record an image.

As shown in FIG. 3, the ASIC 94 includes an output circuit 94*a*, and a transfer circuit 94*b*.

The output circuit 94*a* generates a waveform signal FIRE and a selection signal SIN and outputs these signals to the transfer circuit 94*b* every recording cycle.

The waveform signal FIRE is a serial signal produced by serializing the four ejection drive signals Sa0-Sa3 (see FIG. 4).

The selection signal SIN is a serial signal that includes selection data for selecting one of the four ejection drive signals Sa0-Sa3. A selection signal SIN is generated for each actuator 13*x* in each recording cycle based on the image data included in the recording command.

The transfer circuit 94*b* transfers the waveform signal FIRE and selection signal SIN received from the output circuit 94*a* to the driver IC 14. A low-voltage differential signaling (LVDS) driver is built into the transfer circuit 94*b* for each signal. The LVDS drivers transfer each signal to the driver IC 14 as a pulsed differential signal.

In a recording process, the ASIC 94 controls the driver IC 14 to generate one of the ejection drive signals Sa0-Sa3 for each pixel based on the waveform signal FIRE and selection signal SIN and to supply the ejection drive signals Sa0-Sa3 to the corresponding individual electrodes 13*c* via the signal lines 14*s*. Through this process, the ASIC 94 controls the inkjet head 10 to eject ink from the plurality of nozzles N for each pixel at ejection quantities selected from among the four types of quantities (zero, small, medium, and large).

In addition to the driver IC 14, carriage motor 30*m*, conveying motor 50*m*, cap lifting/lowering motor 70*m*, and suction pump 70*p*, the ASIC 94 is electrically connected to a timer 80, a temperature sensor 81, and a humidity sensor 82.

The timer 80 outputs data specifying timings to the CPU 91. The temperature sensor 81 detects ambient temperature in the inkjet head 10 and outputs data representing this temperature to the CPU 91. The humidity sensor 82 detects ambient humidity in the inkjet head 10 and outputs data specifying this humidity to the CPU 91.

Next, a program executed by the CPU 91 will be described with reference to FIGS. 5 and 6.

At the start timing of the program, the inkjet head 10 is positioned above the cap 70 (see FIG. 1) and the cap 70 is in the capping state. At this time, nozzles N constituting the nozzle row Nk are covered by the first cap 71, while nozzles N constituting the nozzle rows Nc, Nm, and Ny are covered by the second cap 72.

Figure 5:
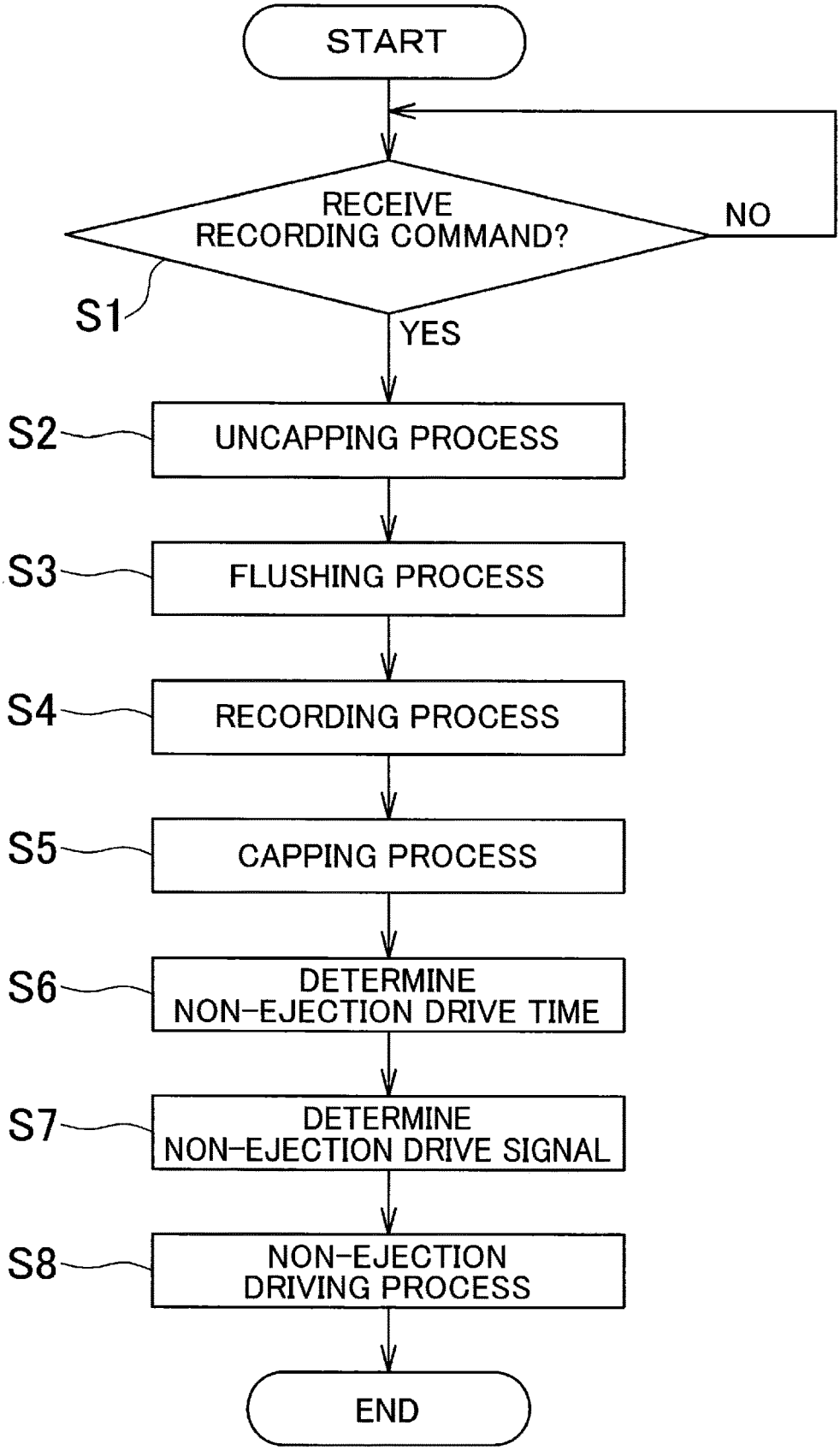
FIG. 5 is a flowchart illustrating a program executed by a CPU of the printer.

In S1 at the beginning of FIG. 5, the CPU 91 determines whether a recording command was received from the external device 150 or the like. While a recording command has not been received (S1: NO), the CPU 91 continually repeats the process of S1.

When a recording command is received (S1: YES), in S2 the CPU 91 drives the cap lifting/lowering motor 70*m* to move the cap 70 downward, thereby moving the cap 70 from the capping state to the non-capping state (uncapping process).

After completing the uncapping process of S2, in S3 the CPU 91 drives the carriage motor 30*m*, which drives the scanning mechanism 30 to move the inkjet head 10 in the scanning direction toward the ink receiving member 60 (see FIG. 1). As each of the nozzle rows Nc, Nm, Ny, and Nk in the moving inkjet head 10 arrives at a position over the ink receiving member 60, the CPU 91 drives the driver IC 14 according to flushing data, which is different from image data (flushing process). At this time, the driver IC 14 deforms the corresponding actuators 13*x*, ejecting ink from the nozzles N belonging to the corresponding nozzle row. The ejected ink is collected in the flushing region 60*r* and flows into the waste ink tank 77.

In S4 the CPU 91 drives the driver IC 14, carriage motor 30*m*, and conveying motor 50*m* based on a recording command in order to alternately perform a conveying operation to convey the sheet 1 with the conveying mechanism 50 a prescribed distance in the conveying direction, and a scanning operation to eject ink from nozzles N while moving the inkjet head 10 in the scanning direction (recording process).

In S5 the CPU 91 drives the carriage motor 30*m*, which drives the scanning mechanism 30 to move the inkjet head 10 in the scanning direction and to position the inkjet head 10 above the cap 70, and subsequently drives the cap lifting/lowering motor 70*m* to lift the cap 70, moving the cap 70 from the non-capping state to the capping state (capping process). Through this operation, the nozzles N constituting the nozzle row Nk are covered by the first cap 71, while the nozzles N constituting the nozzle rows Nc, Nm, and Ny are covered by the second cap 72.

In S6 the CPU 91 sets a non-ejection drive time based on an uncapped time and the ambient temperature and humidity (setting process). The non-ejection drive time is the length of time for executing a non-ejection driving process in S8 described later. The uncapped time is the length of time from the timing at which the cap 70 was switched to the non-capping state in S2 until the timing at which the cap 70 was switched back to the capping state in S5.

More specifically, in S6 the CPU 91 acquires the uncapped time based on data the timer 80 outputted to the CPU 91, acquires the ambient temperature in the inkjet head 10 based on data the temperature sensor 81 outputted to the CPU 91, and acquires the ambient humidity in the inkjet head 10 based on data the humidity sensor 82 outputted to the CPU 91. Next, the CPU 91 extracts the non-ejection drive time corresponding to the acquired uncapped time, ambient temperature, and ambient humidity from a table stored in the ROM 92. The table specifies correlations between uncapped times, ambient temperatures, and ambient humidities and non-ejection drive times. Alternatively, the CPU 91 may calculate the non-ejection drive time based on the acquired uncapped time, ambient temperature, and ambient humidity using a formula stored in the ROM 92 for calculating a non-ejection drive time from an uncapped time, ambient temperature, and ambient humidity. Hence, the process of "setting the non-ejection drive time" may signify extracting the non-ejection drive time from a table, calculating the non-ejection drive time using a formula, or the like.

Figure 6:
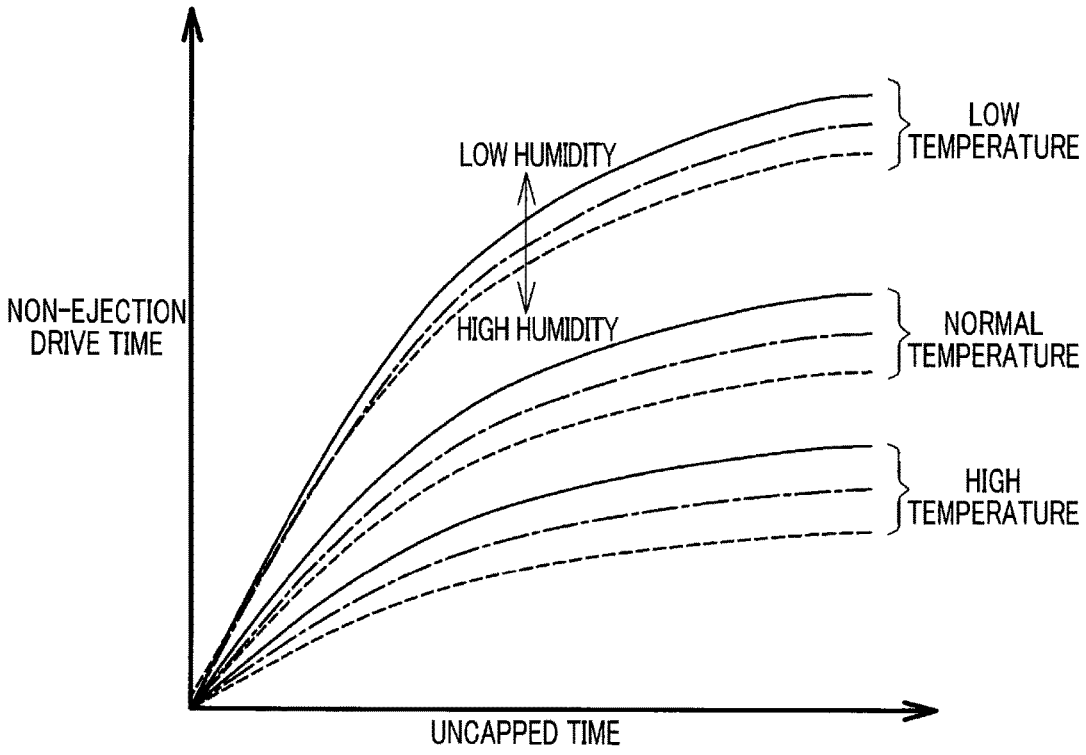
FIG. 6 is a graph to which a table or formula in S6 conforms showing a relationship between an uncapped time and a non-ejection drive time.

The table or formula used in S6 conforms to the graph in FIG. 6, for example. As shown in FIG. 6, the non-ejection drive time increases as the uncapped time increases between an uncapped time of zero and a prescribed time. Further, ambient temperature is classified as one of low temperature, normal temperature, and high temperature, where low temperature is a lower ambient temperature than normal temperature and high temperature is a higher ambient temperature than normal temperature. The non-ejection drive time is longer for lower ambient temperatures. Ambient humidity is also classified as one of low humidity, normal humidity, and high humidity, and the non-ejection drive time is longer for lower ambient humidities. Hence, in S6 the CPU 91 sets the non-ejection drive time to a shorter time for a higher ambient temperature and to a shorter time for a higher ambient humidity.

Subsequently, in S7 the CPU 91 sets the non-ejection drive signal Sb to be used in the non-ejection driving process of S8 described later.

More specifically, in S7 the CPU 91 extracts the number of pulses P per unit time T, the pulse width W, the wave height (the drive potential VDD), and the drive cycle (the unit time T) for the non-ejection drive signal Sb corresponding to the acquired uncapped time, ambient temperature, and ambient humidity from a table stored in the ROM 92 (a table specifying correlations between uncapped time, ambient temperature, and ambient humidity; and number of pulses P per unit time T, pulse width W, wave height (drive potential VDD), and drive cycle for the non-ejection drive signal Sb). Alternatively, the CPU 91 may calculate the number pulses P per unit time T, the pulse width W, the wave height, and the drive cycle of the non-ejection drive signal Sb from the acquired uncapped time, ambient temperature, ambient humidity using a formula stored in the ROM 92 (a formula for calculating the number of pulses P per unit time T, the pulse width W, the wave height, and the drive cycle for the non-ejection drive signal Sb from the uncapped time, ambient temperature, and ambient humidity). Hence, the action of "setting the non-ejection drive signal Sb" signifies extracting the above elements of the non-ejection drive signal Sb from a table, calculating the above elements of the non-ejection drive signal Sb using a formula, or the like.

The table or formula used in S7 has the following relationships. For a longer uncapped time, the table or formula satisfies at least one of a larger number of pulses P per unit time T in the non-ejection drive signal Sb, a larger pulse width W for the non-ejection drive signal Sb, a larger wave height (drive potential VDD) of the non-ejection drive signal Sb, and a shorter drive cycle for the non-ejection drive signal Sb. In other words, the non-ejection drive signal Sb has at least one of a larger number of pulses P per unit time T as the uncapped time increases, a larger pulse width W as the uncapped time increases, and a larger wave height as the uncapped time increases. Additionally, for a lower ambient temperature, the table or formula satisfies at least one of a larger number of pulses P per unit time T in the non-ejection drive signal Sb, a larger pulse width W for the non-ejection drive signal Sb, a larger wave height (drive potential VDD) of the non-ejection drive signal Sb, and a shorter drive cycle for the non-ejection drive signal Sb. Similarly, for a lower ambient humidity, the table or formula satisfies at least one of a larger number of pulses P per unit time T in the non-ejection drive signal Sb, a larger pulse width W for the non-ejection drive signal Sb, a larger wave height (drive potential VDD) of the non-ejection drive signal Sb, and a shorter drive cycle for the non-ejection drive signal Sb.

After completing the process in S7, in S8 the CPU 91 controls the driver IC 14 to supply the non-ejection drive signal Sb set in S7 to the individual electrodes 13*c* of the nozzle row Nk while maintaining the cap 70 in the capping state. The non-ejection drive signal Sb vibrates the meniscus of ink in the nozzles N of the nozzle row Nk without ejecting ink from the nozzles N of the nozzle row Nk (non-ejection driving process). In other words, the CPU 91 executes the non-ejection driving process of S8 on the nozzle row Nk in the preferred embodiment but does not execute the process on the nozzle rows Nc, Nm, and Ny.

The CPU 91 continues supplying the non-ejection drive signal Sb in S8 for the non-ejection drive time set in S6. That is, the CPU 91 executes the non-ejection driving process for vibrating meniscus of ink in the nozzles N without ejecting ink from the nozzles N for the non-ejection drive time. When the non-ejection drive time has elapsed, the CPU 91 stops the non-ejection drive signal Sb in S8 so that the cap is maintained in the capping state without vibrating the meniscus of ink in the nozzles N until the CPU 91 receives the next recording command in S1. Note that, when a period of time having the same time length as the non-ejection drive time has elapsed from a timing at which the prior non-ejection driving process for vibrating meniscus of ink in the nozzles N is finished, thereafter, the CPU 91 may restart supplying the non-ejection drive signal Sb and may continue supplying the non-ejection drive signal Sb for the non-ejection drive time set in S6 if the next recording command in S1 has not yet been received.

For longer uncapped times, the CPU 91 uses a non-ejection drive signal Sb in S8 that satisfies at least one of a larger number of pulses P per unit time T, a larger pulse width W, a larger wave height (drive potential VDD), and a shorter drive cycle (i.e., a higher driving frequency). For lower ambient temperatures, the CPU 91 uses a non-ejection drive signal Sb that satisfies at least one of a larger number of pulses P per unit time T, a larger pulse width W, a larger wave height (drive potential VDD), and a shorter drive cycle (i.e., a higher driving frequency). For lower ambient humidities, the CPU 91 uses a non-ejection drive signal Sb that satisfies at least one of a larger number of pulses P per unit time T, a larger pulse width W, a larger wave height (drive potential VDD), and a shorter drive cycle (i.e., a higher driving frequency).

Since the wave height (drive potential VDD) of the non-ejection drive signal Sb is varied, the printer 100 may be provided with a plurality of power supply circuits that supply different output voltages, for example. The CPU 91 assigns the power supply circuit that has an output voltage corresponding to the wave height set in S7 to the driver IC 14. According to the voltage from the assigned power supply circuit, the driver IC 14 generates a non-ejection drive signal Sb having the wave height set in S7.

After completing the process in S8, the CPU 91 quits the program.

According to the embodiment described above, the CPU 91 sets a non-ejection drive time based on the uncapped time (S6). As a result, the CPU 91 can avoid executing the non-ejection driving process longer than necessary and, hence, can avoid delaying the start of the next recording process. Therefore, the present embodiment can implement high-speed recording with a configuration for executing a non-ejection driving process while the cap 70 is in the capping state.

In the setting process of S6, the CPU 91 sets the non-ejection drive time based on the uncapped time and at least one of the ambient temperature and ambient humidity (both the ambient temperature and ambient humidity in the embodiment). Ambient temperature and humidity greatly influence the rate that ink thickens. Therefore, a suitable non-ejection drive time can be obtained by setting the non-ejection drive time based not solely on the uncapped time, but also on at least one of ambient temperature and ambient humidity.

In the setting process of S6, the CPU 91 sets a shorter non-ejection drive time for higher ambient temperatures (see FIG. 6). Since moisture diffusion occurs rapidly in ink at high ambient temperatures, nozzles N are replenished with ink from the inkjet head 10 so that the ink in the nozzles N is unlikely to thicken. By shortening the non-ejection drive time for higher ambient temperatures in the embodiment, the CPU 91 can more reliably achieve high-speed recording while suppressing the thickening of ink.

In the setting process of S6, the CPU 91 sets a shorter non-ejection drive time for higher ambient humidities (see FIG. 6). Ink is unlikely to thicken in the nozzles N at higher ambient humidities. Therefore, by shortening the non-ejection drive time for higher ambient humidities, the embodiment can more reliably achieve high-speed recording while suppressing the thickening of ink.

In the non-ejection driving process of S8, the CPU 91 uses a non-ejection drive signal Sb having a larger number of pulses P per unit time T for a longer uncapped time. The longer the uncapped time, the more drying progresses in ink deposited in the cap 70, such as ink that was forcibly discharged from the nozzle N by the suction pump 70*p* (see FIG. 1) and collected in the cap 70. Dried ink in the cap 70 functions as a moisture absorbent when the ink contains a moisture-absorbing material. When the cap 70 is in the capping state, the dried ink can absorb moisture from ink in the nozzles N, accelerating the thickening of ink in the nozzles N. Therefore, the CPU 91 in the embodiment uses a non-ejection drive signal Sb having a larger number of pulses P per unit time T when the uncapped time is longer in order to increase the vibrating force on ink in the nozzles N during the non-ejection driving process of S8 and more reliably suppress the thickening of ink. Conversely, if the uncapped time is short, the CPU 91 uses a non-ejection drive signal Sb having fewer pulses P per unit time T, thereby reducing power consumption.

In the non-ejection driving process of S8, the CPU 91 uses a non-ejection drive signal Sb having a larger pulse width W for a longer uncapped time. The longer the uncapped time, the more drying progresses in ink deposited in the cap 70, such as ink that was forcibly discharged from the nozzle N by the suction pump 70*p* (see FIG. 1) and collected in the cap 70. Dried ink in the cap 70 functions as a moisture absorbent when the ink contains a moisture-absorbing material. When the cap 70 is in the capping state, the dried ink can absorb moisture from ink in the nozzles N, accelerating the thickening of ink in the nozzles N. Therefore, the CPU 91 in the embodiment uses a non-ejection drive signal Sb having a larger pulse width W when the uncapped time is longer in order to increase the vibrating force on ink in the nozzles N during the non-ejection driving process of S8 and more reliably suppress the thickening of ink. Conversely, if the uncapped time is short, the CPU 91 uses a non-ejection drive signal Sb having a smaller pulse width W, thereby reducing power consumption.

In the non-ejection driving process of S8, the CPU 91 uses a non-ejection drive signal Sb having a larger wave height (drive potential VDD) for a longer uncapped time. The longer the uncapped time, the more drying progresses in ink deposited in the cap 70, such as ink that was forcibly discharged from the nozzle N by the suction pump 70*p* (see FIG. 1) and collected in the cap 70. Dried ink in the cap 70 functions as a moisture absorbent when the ink contains a moisture-absorbing material. When the cap 70 is in the capping state, the dried ink can absorb moisture from ink in the nozzles N, accelerating the thickening of ink in the nozzles N. Therefore, the CPU 91 in the embodiment uses a non-ejection drive signal Sb having a larger wave height when the uncapped time is longer in order to increase the vibrating force on ink in the nozzles N during the non-ejection driving process of S8 and more reliably suppress the thickening of ink. Conversely, if the uncapped time is short, the CPU 91 uses a non-ejection drive signal Sb having a smaller wave height, thereby reducing power consumption.

In the non-ejection driving process of S8, the CPU 91 uses a non-ejection drive signal Sb having a shorter drive cycle (i.e., a higher driving frequency) for a longer uncapped time. The longer the uncapped time, the more drying progresses in ink deposited in the cap 70, such as ink that was forcibly discharged from the nozzle N by the suction pump 70*p* (see FIG. 1) and collected in the cap 70. Dried ink in the cap 70 functions as a moisture absorbent when the ink contains a moisture-absorbing material. When the cap 70 is in the capping state, the dried ink can absorb moisture from ink in the nozzles N, accelerating the thickening of ink in the nozzles N. Therefore, the CPU 91 in the embodiment uses a non-ejection drive signal Sb having a shorter drive cycle (a higher driving frequency) when the uncapped time is longer in order to increase the vibrating force on ink in the nozzles N during the non-ejection driving process of S8 and more reliably suppress the thickening of ink. Conversely, if the uncapped time is short, the CPU 91 uses a non-ejection drive signal Sb having a long drive cycle (i.e., a low driving frequency), thereby reducing power consumption.

In the non-ejection driving process of S8, the CPU 91 uses a non-ejection drive signal Sb having a larger number of pulses P per unit time T for a lower ambient temperature. Since moisture diffusion in ink is slower when ambient temperature is lower, the nozzles N are less likely to be replenished with ink from the inkjet head 10, and ink is more likely to thicken in the nozzles N. Therefore, the CPU 91 in the embodiment uses a non-ejection drive signal Sb having a larger number of pulses P per unit time T when the ambient temperature is lower in order to increase the vibrating force on ink in the nozzles N during the non-ejection driving process of S8 and more reliably suppress the thickening of ink. Conversely, if the ambient temperature is higher, the CPU 91 uses a non-ejection drive signal Sb having fewer pulses P per unit time T, thereby reducing power consumption.

In the non-ejection driving process of S8, the CPU 91 uses a non-ejection drive signal Sb having a larger pulse width W for a lower ambient temperature. Since moisture diffusion in ink is slower when ambient temperature is lower, the nozzles N are less likely to be replenished with ink from the inkjet head 10, and ink is more likely to thicken in the nozzles N. Therefore, the CPU 91 in the embodiment uses a non-ejection drive signal Sb having a larger pulse width W when the ambient temperature is lower in order to increase the vibrating force on ink in the nozzles N during the non-ejection driving process of S8 and more reliably suppress the thickening of ink. Conversely, if the ambient temperature is higher, the CPU 91 uses a non-ejection drive signal Sb having a smaller pulse width W, thereby reducing power consumption.

In the non-ejection driving process of S8, the CPU 91 uses a non-ejection drive signal Sb having a larger wave height (drive potential VDD) for a lower ambient temperature. Since moisture diffusion in ink is slower when ambient temperature is lower, the nozzles N are less likely to be replenished with ink from the inkjet head 10, and ink is more likely to thicken in the nozzles N. Therefore, the CPU 91 in the embodiment uses a non-ejection drive signal Sb having a larger wave height when the ambient temperature is lower in order to increase the vibrating force on ink in the nozzles N during the non-ejection driving process of S8 and more reliably suppress the thickening of ink. Conversely, if the ambient temperature is higher, the CPU 91 uses a non-ejection drive signal Sb having a smaller wave height, thereby reducing power consumption.

In the non-ejection driving process of S8, the CPU 91 uses a non-ejection drive signal Sb having a shorter drive cycle (i.e., a higher driving frequency) for a lower ambient temperature. Since moisture diffusion in ink is slower when ambient temperature is lower, the nozzles N are less likely to be replenished with ink from the inkjet head 10, and ink is more likely to thicken in the nozzles N. Therefore, the CPU 91 in the embodiment uses a non-ejection drive signal Sb having a shorter drive cycle (a higher driving frequency) when the ambient temperature is lower in order to increase the vibrating force on ink in the nozzles N during the non-ejection driving process of S8 and more reliably suppress the thickening of ink. Conversely, if the ambient temperature is higher, the CPU 91 uses a non-ejection drive signal Sb having a longer drive cycle (a lower driving frequency), thereby reducing power consumption.

In the non-ejection driving process of S8, the CPU 91 uses a non-ejection drive signal Sb having a larger number of pulses P per unit time T for a lower ambient humidity. Ink is more likely to thicken in nozzles N at lower ambient humidity. Therefore, the CPU 91 in the embodiment uses a non-ejection drive signal Sb having a larger number of pulses P per unit time T when the ambient humidity is lower in order to increase the vibrating force on ink in the nozzles N during the non-ejection driving process of S8 and more reliably suppress the thickening of ink. Conversely, if the ambient humidity is higher, the CPU 91 uses a non-ejection drive signal Sb having fewer pulses P per unit time T, thereby reducing power consumption.

In the non-ejection driving process of S8, the CPU 91 uses a non-ejection drive signal Sb having a larger pulse width W for a lower ambient humidity. Ink is more likely to thicken in nozzles N at lower ambient humidity. Therefore, the CPU 91 in the embodiment uses a non-ejection drive signal Sb having a larger pulse width W when the ambient humidity is lower in order to increase the vibrating force on ink in the nozzles N during the non-ejection driving process of S8 and more reliably suppress the thickening of ink. Conversely, if the ambient humidity is higher, the CPU 91 uses a non-ejection drive signal Sb having a smaller pulse width W, thereby reducing power consumption.

In the non-ejection driving process of S8, the CPU 91 uses a non-ejection drive signal Sb having a larger wave height (drive potential VDD) for a lower ambient humidity. Ink is more likely to thicken in nozzles N at lower ambient humidity. Therefore, the CPU 91 in the embodiment uses a non-ejection drive signal Sb having a larger wave height when the ambient humidity is lower in order to increase the vibrating force on ink in the nozzles N during the non-ejection driving process of S8 and more reliably suppress the thickening of ink. Conversely, if the ambient humidity is higher, the CPU 91 uses a non-ejection drive signal Sb having a smaller wave height, thereby reducing power consumption.

In the non-ejection driving process of S8, the CPU 91 uses a non-ejection drive signal Sb having a shorter drive cycle (a higher driving frequency) for a lower ambient humidity. Ink is more likely to thicken in nozzles N at lower ambient humidity. Therefore, the CPU 91 in the embodiment uses a non-ejection drive signal Sb having a shorter drive cycle (a higher driving frequency) when the ambient humidity is lower in order to increase the vibrating force on ink in the nozzles N during the non-ejection driving process of S8 and more reliably suppress the thickening of ink Conversely, if the ambient humidity is higher, the CPU 91 uses a non-ejection drive signal Sb having a longer drive cycle (a lower driving frequency), thereby reducing power consumption.

In the capping process of S5, the CPU 91 drives the scanning mechanism 30 and cap lifting/lowering motor 70*m* so that the first cap 71 covers the nozzle row Nk and the second cap 72 covers the nozzle rows Nc, Nm, and Ny (see FIG. 1). The CPU 91 then executes the non-ejection driving process of S8 on the nozzle row Nk but not on the nozzle rows Nc, Nm, and Ny. As ink deposited in the first cap 71 dries, the dried ink functions as an absorbing agent since ink ejected from the nozzle row Nk contains a water-absorbing material. When the cap 70 is in the capping state, the dried ink absorbs moisture from ink in the nozzles N, accelerating the thickening of ink in the nozzles N. However, this problem is unlikely to occur for ink ejected from the nozzle rows Nc, Nm, and Ny since their ink does not contain a water-absorbing material. Therefore, the CPU 91 executes the non-ejection driving process of S8 for the nozzle row Nk in order to suppress the thickening of ink in the nozzles N but does not perform the non-ejection driving process for the nozzle rows Nc, Nm, and Ny, thereby reducing power consumption.

Second Embodiment

Figure 7:
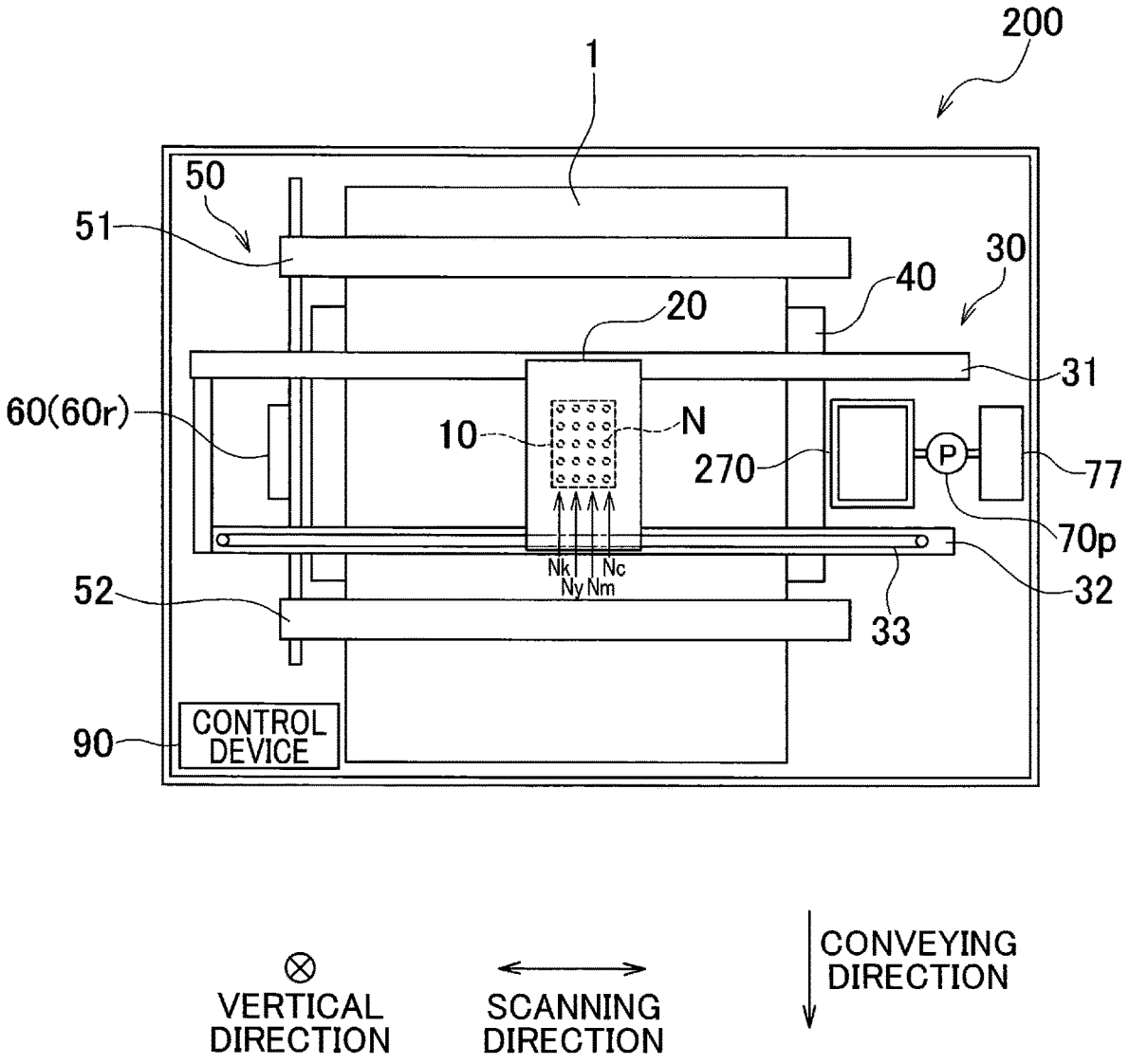
FIG. 7 is a plan view illustrating an overall structure of a printer.

Next, a printer 200 according to a second embodiment of the present disclosure will be described with reference to FIGS. 7 and 8.

In the first embodiment described above, the cap 70 (see FIG. 1) includes the first cap 71 for covering the nozzle row Nk and the second cap 72 for covering the nozzle rows Nc, Nm, and Ny. In the second embodiment, a cap 270 (see FIG. 7) covers all nozzles N belonging to the four nozzle rows Nc, Nm, Ny, and Nk. In the capping process (S5) according to the second embodiment, the CPU 91 drives the scanning mechanism 30 and cap lifting/lowering motor 70*m* so that the cap 270 covers all nozzles N constituting the four nozzle rows Nc, Nm, Ny, and Nk (i.e., the nozzle row Nk corresponding to the "first nozzle group" and the nozzle rows Nc, Nm, and Ny corresponding to the "second nozzle group").

In the setting process (S6) according to the second embodiment, the CPU 91 individually sets a non-ejection drive time T1 (the first time) for the nozzle row Nk and a non-ejection drive time T2 (the second time) for the nozzle rows Nc, Nm, and Ny. The non-ejection drive time T2 is set shorter than the non-ejection drive time T1 (T2<T1).

Figure 8:
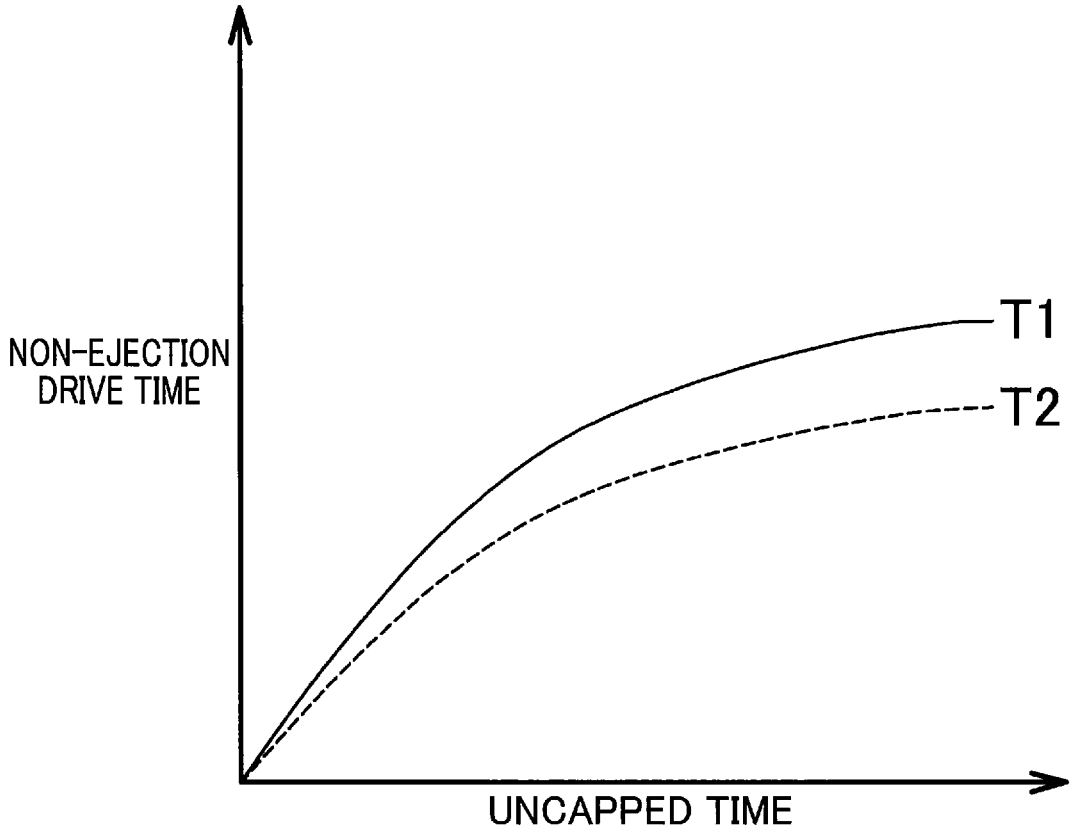
FIG. 8 is a graph to which a table or formula in S6 conforms showing a relationship between an uncapped time and a non-ejection drive time.

The table or formula used in the setting process of S6 corresponds to the graph in FIG. 8, for example. FIG. 8 shows the non-ejection drive times T1 and T2 corresponding to uncapped times when the ambient temperature and humidity are equivalent for both cases. Note that the relationship T2<T1 is maintained at all uncapped times.

In the non-ejection driving process of S8, the CPU 91 controls the driver IC 14 to supply the non-ejection drive signal Sb set in S7 to the individual electrodes 13*c* of all nozzle rows Nc, Nm, Ny, and Nk while maintaining the cap 270 in the capping state. The non-ejection drive signal Sb vibrates the meniscus of ink in the nozzles N for all nozzle rows Nc, Nm, Ny, and Nk without ejecting ink from the nozzles N for all nozzle rows Nc, Nm, Ny, and Nk. In other words, in the second embodiment the CPU 91 executes the non-ejection driving process of S8 on all nozzle rows Nc, Nm, Ny, and Nk.

The CPU 91 continues supplying the non-ejection drive signal Sb in S8 to the individual electrodes 13*c* in the nozzle row Nk for the non-ejection drive time T1 (the first time) and to the individual electrodes 13*c* in the nozzle rows Nc, Nm, and Ny for the non-ejection drive time T2 (the second time).

The second embodiment described above obtains the following effects in addition to those accorded to similar structures with the first embodiment.

As ink ejected from the nozzle row Nk and deposited in the first cap 71 dries, the dried ink functions as an absorbing agent since the ink contains a water-absorbing material. When the cap 70 is in the capping state, the dried ink absorbs moisture from ink in the nozzles N, accelerating the thickening of ink in the nozzles N. However, this problem is unlikely to occur for ink ejected from the nozzle rows Nc, Nm, and Ny since their ink does not contain a water-absorbing material. Therefore, the CPU 91 in the second embodiment sets the non-ejection drive time T2 for the nozzle rows Nc, Nm, and Ny shorter than the non-ejection drive time T1 for the nozzle row Nk, thereby reducing power consumption.

Variations of the Embodiments

While the description has been described in detail with reference to specific embodiments thereof, it would be apparent to those skilled in the art that many modifications and variations may be made therein without departing from the spirit of the disclosure, the scope of which is defined by the attached claims.

The inkjet head in the embodiments described above is provided with nozzles that eject liquids of mutually different types (pigment inks and dye inks, and inks of different colors), but the scope of the present disclosure is not limited to this configuration. For example, the inkjet head may be provided with nozzles that eject liquids of the same type, such as only pigment inks, only dye inks, or only inks of the same color.

In the embodiments described above, the control unit acquires the ambient temperature and humidity based on data outputted from a temperature sensor and humidity sensor, but the control unit may acquire the ambient temperature and humidity based on data inputted from the user.

In the setting process, the control unit may set the non-ejection drive time based on the uncapped time and one of the ambient temperature and ambient humidity. Alternatively, the control unit may set the non-ejection drive time in the setting process based solely on the uncapped time and not on either of the ambient temperature and ambient humidity.

While a serial-type print head is used in the embodiment, a line-type print head may be used instead.

The liquid ejected from nozzles of the print head is not limited to ink but may be a liquid other than ink, such as a treatment liquid for aggregating or precipitating components of the ink.

The recording medium is not limited to paper but may be fabric, resin material, or the like.

The scope of the present disclosure is not limited to a printer but may be applied to a facsimile machine, a copy machine, a multifunction peripheral, or the like. Alternatively, the present disclosure may be applied to a liquid-ejecting device used in applications other than recording images, such as a liquid-ejecting device for forming conductive patterns by ejecting a conductive liquid onto a substrate.

The program according to the present disclosure may be recorded for distribution on a removable storage medium, such as a flexible disk, or a built-in storage medium, such as a hard disk, or may be distributed via communication lines.

While the description has been made in detail with reference to the embodiments, it would be apparent to those skilled in the art that many modifications and variations may be made thereto.

What is claimed is:

1. A liquid ejecting device comprising:

a head including a plurality of nozzles;

a cap;

a moving mechanism configured to move the head and the cap relative to each other to switch the cap between a capping state in which the cap is in contact with the head and covers the plurality of nozzles and a non-capping state in which the cap is separated from the head and uncovers the plurality of nozzles; and a controller configured to perform:

first switching the cap from the capping state to the non-capping state by driving the moving mechanism;

after completing the first switching, second switching the cap from the non-capping state to the capping state by driving the moving mechanism;

setting a non-ejection drive time based on an uncapped time duration which is a length of time from a timing at which the cap is switched to the non-capping state in the first switching until a timing at which the cap is switched back to the capping state in the second switching;

after completing the second switching, vibrating meniscus of liquid in the plurality of nozzles without ejecting the liquid from the plurality of nozzles for the non-ejection drive time set in the setting while maintaining the cap in the capping state; and after completing the vibrating meniscus of the liquid in the plurality of nozzles, maintaining the cap in the capping state without vibrating the meniscus until receiving a recording command.

2. The liquid ejecting device according to claim 1, wherein, in the setting, the controller is configured to perform determining the non-ejection drive time based on one of a combination of the uncapped time duration and a temperature, a combination of the uncapped time duration and a humidity, and a combination of the uncapped time, the temperature and the humidity.

3. The liquid ejecting device according to claim 2, wherein, in the setting, the controller is configured to perform setting the non-ejection drive time to a shorter time for a higher temperature.

4. The liquid ejecting device according to claim 2, wherein, in the setting, the controller is configured to perform setting the non-ejection drive time to a shorter time for a higher humidity.

5. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a larger number of pulses per unit time as the uncapped time increases.

6. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a larger pulse width as the uncapped time increases.

7. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a larger wave height as the uncapped time increases.

8. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a higher driving frequency as the uncapped time increases.

9. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a larger number of pulses per unit time for a lower temperature.

10. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a larger pulse width for a lower temperature.

11. The liquid ejecting device according to claim 1, wherein, in the vibrating, the controller is configured to perform using a non-ejection drive signal for vibrating the meniscus of the liquid in the plurality of nozzles without ejecting liquid from the plurality of nozzles, the non-ejection drive signal having a larger wave height for a lower temperature.

12. The liquid ejecting device according to claim 1, wherein, in the vibrating, the controller is configured to perform using a non-ejection drive signal for vibrating the meniscus of the liquid in the plurality of nozzles without ejecting the liquid from the plurality of nozzles, the non-ejection drive signal having a higher driving frequency for a lower temperature.

13. The liquid ejecting device according to claim 1, wherein, in the vibrating, the controller is configured to perform using a non-ejection drive signal for the vibrating the meniscus of the liquid in the plurality of nozzles without ejecting liquid from the plurality of nozzles, the non-ejection drive signal having a larger number of pulses per unit time for a lower humidity.

14. The liquid ejecting device according to claim 1, wherein, in the vibrating, the controller is configured to perform using a non-ejection drive signal for vibrating the meniscus of the liquid in the plurality of nozzles without ejecting liquid from the plurality of nozzles, the non-ejection drive signal having a larger pulse width for a lower humidity.

15. The liquid ejecting device according to claim 1, wherein, in the vibrating, the controller is configured to perform using a non-ejection drive signal for vibrating the meniscus of the liquid in the plurality of nozzles without ejecting liquid from the plurality of nozzles, the non-ejection drive signal having a larger wave height for a lower humidity.

16. The liquid ejecting device according to claim 1, wherein, in the vibrating, the controller is configured to perform using a non-ejection drive signal for vibrating the meniscus of the liquid in the plurality of nozzles without ejecting liquid from the plurality of nozzles, the non-ejection drive signal having a higher driving frequency for a lower humidity.

17. The liquid ejecting device according to claim 1, wherein the plurality of nozzles includes:

a first nozzle group configured to eject pigment ink; and a second nozzle group configured to eject dye ink, wherein the cap includes a first cap and a second cap, wherein, in the second switching, the controller is configured to perform moving the moving mechanism such that the first nozzle group is covered by the first cap, while the second nozzle group is covered by the second cap, wherein, in the vibrating, the controller is configured to perform the vibrating to the first nozzle group, and wherein, in the vibrating, the controller is configured not to perform the vibrating to the second nozzle group.

18. The liquid ejecting device according to claim 1, wherein the plurality of nozzles includes:

a first nozzle group configured to eject pigment ink; and a second nozzle group configured to eject dye ink, wherein, in the second switching, the controller is configured to perform moving the moving mechanism such that both the first nozzle group and the second nozzle group are covered by the cap, and wherein, in the setting, the controller is configured to set a first non-ejection drive time for the first nozzle group and a second non-ejection drive time for the second nozzle group, the second non-ejection drive time being set shorter than the first non-ejection drive time.

* * * * *